United States Patent [19]

Riedl

[11] 4,395,872

[45] Aug. 2, 1983

[54] ASYMMETRICAL FALSE-TWIST TEXTURING MACHINE

[75] Inventor: Walter Riedl, Neusäss, Fed. Rep. of Germany

[73] Assignee: Ernst Michalke GmbH & Co., Langweid am Lech, Fed. Rep. of Germany

[21] Appl. No.: 263,029

[22] Filed: May 12, 1981

[30] Foreign Application Priority Data

May 14, 1980 [DE] Fed. Rep. of Germany ..... 3018365

[51] Int. Cl.[3] ..... D01H 13/28; D01H 7/92; D02G 1/02

[52] U.S. Cl. ..... 57/291; 57/290; 57/352

[58] Field of Search ..... 57/290, 291, 352, 282, 57/284

[56] References Cited

U.S. PATENT DOCUMENTS 3,142,951 8/1964 Terra ..... 57/291 X
3,946,546 3/1976 Venot ..... 57/291 X
3,950,928 4/1976 Murakami ..... 57/291
4,051,650 10/1977 Gleyze et al. ..... 57/291
4,141,206 2/1979 Eaves ..... 57/352 X

*Primary Examiner*—Donald Watkins
*Attorney, Agent, or Firm*—Curtis, Morris & Safford

[57] ABSTRACT

The invention relates to a device for false-twist texturing, if appropriate with simultaneous drawing of multifilament threads, said device consisting of a plurality of identical sections located next to one another, in which device the delivery mechanisms and heaters required for each working position are arranged in only one series in each case, the texturing machine has only one operating gangway and one creel installation, and the thread runs of the working positions of a section differ from one another in their angles and/or their length due to a slight oblique pull. These measures make it possible to use common texturing heaters and set heaters for the working positions of a section.

The device is distinguished by a low energy requirement, ease of attendance and good accessibility of all the machine parts in case of repairs.

8 Claims, 4 Drawing Figures

ASYMMETRICAL FALSE-TWIST TEXTURING MACHINE

The present invention relates to a draw false-twist texturing machine, in which the devices required for each texturing point, such as the feed bobbin, delivery mechanism, texturing heater, cooling zone, twist inducer, second delivery mechanism, and, if appropriate, set heater and third delivery mechanism, as well as take-up device, have been arranged in a novel way.

Hitherto known false-twist texturing machines, which are all suitable, in principle, also for the simultaneous drawing of the threads, consist of a plurality of texturing positions which are located in series next to one another and which are not allowed to differ in their equipment and in the thread run. The fear was that even insignificant differences, for example in the thread run or in the distances between the individual units, would necessarily lead to differences in the dye affinity and in the crimping values of the crimp yarns produced. Up to the present time, it has therefore been sufficient to describe the thread run of a thread or yarn to be textured, in order to characterize the mode of operation of the entire machine of, for example, 200 working positions.

The stringent adherence to constant geometrical conditions from one working position to another resulted, necessarily, in the hitherto conventional construction of machines of this type, which, to achieve as great a utilization of area as possible, was carried out on two sides, that is to say, all the components of a false-twist texturing machine of this type were arranged on both sides, symmetrically to a center plane. The machine arrangements according to German Auslegeschrift No. 2,626,731, FIG. 1, and German Auslegeschrift No. 2,352,027, FIG. 1, together with column 3, lines 52 and following, may be mentioned here by way of example. The mirror-image design of machines of this type resulted, necessarily, from the demand for as high a utilization of area and space as possible. If the spatial arrangement of one working position is not to differ from another, the individual working positions, with all the associated machine elements, are, necessarily, to be located in series next to one another; the length of the machine is determined by the absolutely essential width of the machine parts, the twist inducer driven by a flat belt generally determining the width of a working position, also called a machine spacing.

The mirror-image arrangement of the working positions in the form of a series was obvious, since, by means of this arrangement, it was possible to mount on a central frame the rotating parts, such as delivery mechanisms, twist-inducer drives and, if appropriate, take-up devices, and to move these by means of a main drive via appropriate gears.

However, a construction of this type has a series of disadvantages. The following may be referred to here in particular:

A mirror-image design of a texturing machine implies two operating gangways per machine, which cannot be monitored from a common point. The operating personnel has relatively large distances to cover.

The texturing heaters and also the set heaters, which are present, if appropriate, extend, in a mirror image, on both sides of the machine over the entire length of the machine. Consequently, they have very large heat-emitting surfaces. In the case of the conventional wall thicknesses of the heat insulation, this leads to the regrettable fact that only approximately 2 to 12% of the heating energy supplied serves to heat the thread, whilst the rest has to be nullified by the air-conditioning system which is conventionally present. According to the state of the art, each machine has two creel parts which are relatively far removed from one another and which entail long distances for the operating personnel to cover. When several texturing machines of this type, having a mirror-image design, are provided, there is, furthermore, the danger that the delivery yarns will be inadvertently interchanged, since the creel part of one machine comes to rest next to the creel part of the next machine.

Consequently, the object was to design a false-twist texturing machine, in which, with the same space requirement, the disadvantages indicated are not to be found or are to be found only to a greatly reduced extent, and which would be distinguished, in particular, by the following further properties.

The achievement of high working speeds up to 1,000 meters per minutes and above low energy requirement ease of attendance because of a compact design and short distances to cover a low repair outlay and good accessibility of all machine parts.

It has now been found that, in a multi-point texturing machine, it is, surprisingly, not absolutely necessary for the thread run to be uniform in every working position. Rather, it is possible to vary the thread run slightly from position to position, without an impairment of the texturing quality or of the dyeing uniformity having to be feared. For example, it is permissible, within certain limits, to vary the running length of the threads and the angles of the direction changes between the first delivery mechanism and the texturing heater and between the texturing heater and the false-twist inducer. Because of these surprising results, it was possible to design a texturing machine for false-twist texturing or for simultaneous draw false-twist texturing, this texturing machine no longer having the defects mentioned above. The texturing machine according to the invention for false-twist texturing, if appropriate with simultaneous drawing of multi-filament threads, consists, in this case, like the device according to the state of the art, of a plurality of identical sections which are located next to one another and which each have approximately 10 to 30 working positions located next to one another. In contrast to the state of the art, however, this texturing machine does not have a mirror-image design, but it has only delivery mechanisms, texturing heaters and set heaters which are arranged, in each case, in a series. The texturing machine according to the invention has an asymmetrical construction, with only one operating gangway and only one creel installation. Such a texturing machine arranged asymmetrically has no greater space requirement than the hitherto known devices having a mirror-image design, inasmuch as the thread run of the threads, in the individual working positions of a section, can differ in its angle and/or in its length from that of the adjacent position. These differences are obtained by means of a slight oblique pull of the thread runs of the various working positions.

In a preferred embodiment, the threads of the working positions of a section are conveyed through a common texturing heater and, if appropriate, through a common set heater. To obtain an especially energy-saving embodiment, it is advantageous to lead the individual threads to be treated through the texturing heater by way of separate closed tubes, these tubes in the texturing heater advantageously being combined into a compact bundle. An especially narrow machine spacing is possible, if the twist inducers are arranged not, as hitherto, in one series, but in several series, if appropriate also spatially offset relative to one another.

In further preferred embodiments, the thread run of the individual working positions is fixed, not only in the texturing heater, but also in the cooling zone, or from the creel to the first delivery mechanism and from the first delivery mechanism to the texturing heater and through this heater, and in the cooling zone, through pipelines for the individual threads. These pipelines can, for example, be tubes made of stainless steel with a small diameter. Especially suitable are tubes having an inside diameter of, for example, 6 to 10 mm, which are fitted at their ends, but, if appropriate, also at direction-change points, with thread-guide devices made, for example, of sintered ceramic or the like. In order also to guarantee the easy attachment of the threads to the take-up devices, pipelines for thread guidance can be used, again, also in the subsequent thread run. For example, this is the case for guiding the textured threads through from the last delivery mechanism to the take-up device under the working platform.

The attached figures will serve for further illustration of the invention.

Figure 1:
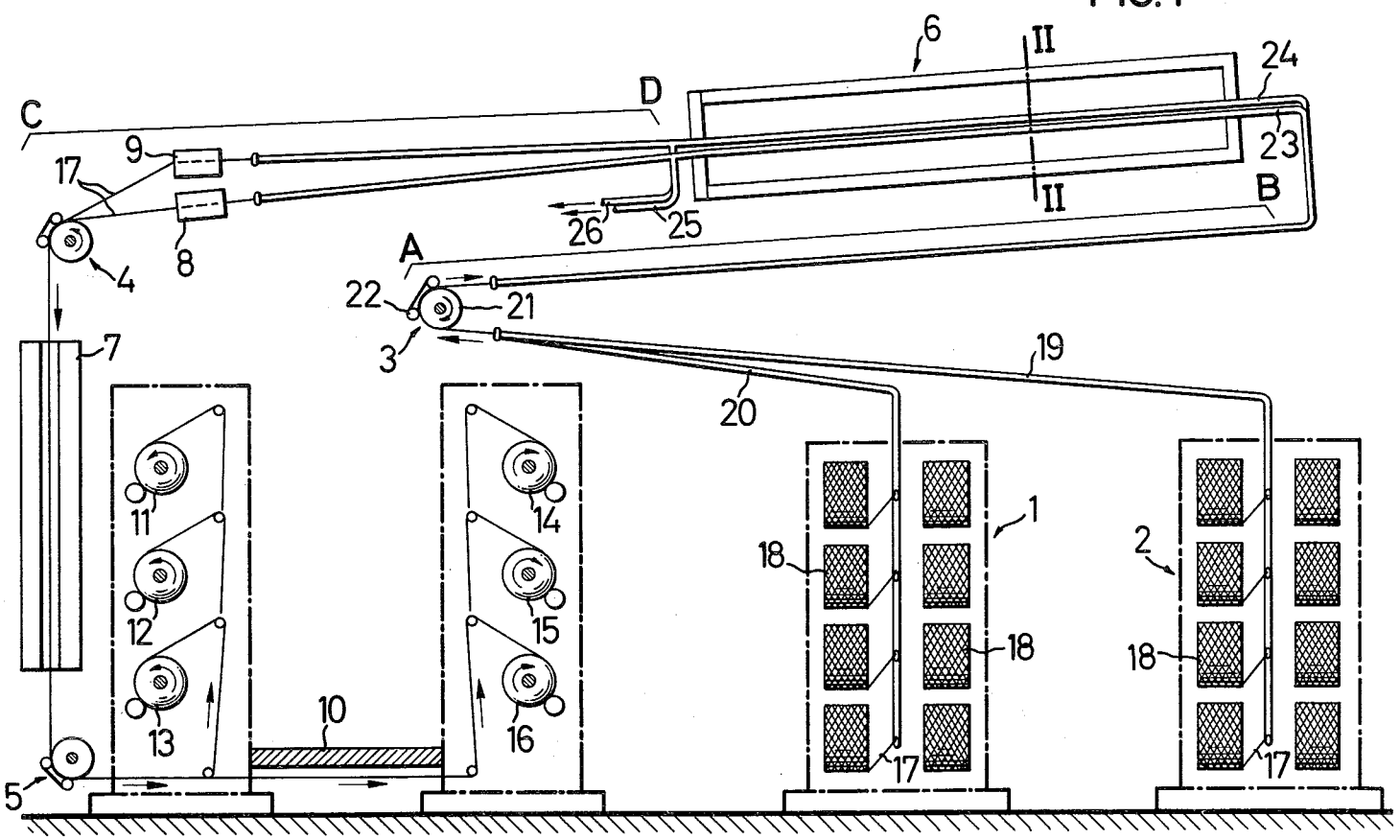
FIG. 1 shows diagrammatically a side view of the device according to the invention.

It is evident from FIG. 1 that the device according to the invention has an asymmetrical construction, the creels 1 and 2 are combined next to one another into a creel installation, and the delivery mechanisms 3, 4 and 5 are each present once only. The same applies to the texturing heater 6 located above the creel installation and to the set heater 7. In contrast to this, the twist inducers 8 and 9 are arranged in two series and are spatially offset relative to one another. The device has only one working platform 10, from which all the important parts of the device can be monitored and can be reached for the purpose of starting operation. This applies, in particular, to the first delivery mechanism 3, the twist inducers 8 and 9, the second delivery mechanism 4 and the take-up units 11–16.

The mode of operation and the special design of the device will now be described in more detail with reference to the thread run of a few selected working positions. The starting material, for example multi-filament threads 17, is taken off, overhead, from draw-winder bobbins or, as partly drawn thread material, from spinning packages 18 and is guided to the first delivery mechanism 3 via thread-guide devices 19, 20. This delivery mechanism consists, in a conventional way, of a continuous shaft 21 and belt drives 22 which can be pivoted inwards. A belt drive 22 which can be pivoted inwards separately is provided for each working position. The threads 17 to be treated are subsequently each guided in separate thread-guide devices. Only two of these thread-guide devices, bearing the reference numerals 23 and 24, are illustrated in FIG. 1 for the sake of clarity. These thread-guide devices, which preferably have the form of thin-walled tubes, subsequently run through the texturing heater 6 and over the further distance from the outlet of the texturing heater 6 up to the twist inducers 8, 9, this last mentioned distance representing the cooling zone for the threads 17 to be treated in the individual working positions. After leaving the texturing heater 6, the individual thread-guide devices are appropriately provided with pipe connections leading to an exhausting system. By means of this known measure, it is possible to extract vapors arising in the individual pipelines during their run through the texturing heater 6. These pipe connections 25, 26 conventionally have valves or flaps which can be closed during the attaching operation, for example by means of suction pistols. These switching members are not illustrated in FIG. 1.

As already indicated above, the actual twist inducers 8, 9 are arranged in two series above one another and are laterally offset. In the embodiment according to FIG. 1, they are located at a height above the head of the operator who stands on the platform 10. Single-disc or multi-disc friction twist inducers are preferably provided as twist inducers, since working speeds of 1,000 meters per minute or above can be adhered to, up to the present time, only by means of these devices.

The threads run again from the twist inducers 8, 9 onto a common delivery mechanism 4 which has basically the same design as the delivery mechanism 3, and, subsequently, if desired, through a set heater 7 and a further delivery mechanism 5 to the take-up devices 11–16.

By means of the asymmetrical design, the permitted slight oblique pulls from the creel installation to the second delivery mechanism 4 and the spatially offset arrangement of the twist inducers 8, 9, it is possible to ensure an especially narrow machine spacing. All the essential apparatus parts of the texturing machine claimed can be monitored or operated from a single working gangway 10.

Figure 2:
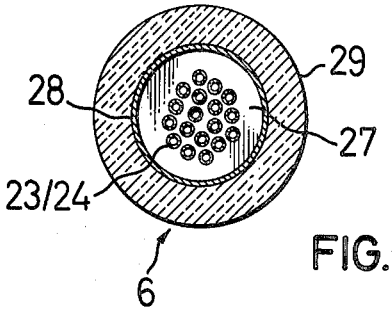
FIG. 2 represents a cross-section through the texturing heater along the sectional line II—II in FIG. 1, whilst

A section at the point II—II through the texturing heater 6 is illustrated in FIG. 2. In this compact heater, 18 thread-guide devices are combined in the form of tubes into a close-packed bundle. Only two of these 18 tubes have been indicated in FIG. 1 for the sake of clarity. In FIG. 1 they bore the reference numerals 23, 24. The bundle of tubes is surrounded by a heating space 27 which is closed off from the outside by the sheath 28. The heating space 27 can, for example, be an empty space, through which diphenyl/diphenyl-oxide vapour or another heating medium flows, if appropriate with condensation, but it can also contain electrical heating devices or the like. Arranged round the sheath of the heating body is thermal insulation 29 which is designed so that the heat losses into the space are as slight as possible. In contrast to the hitherto conventional texturing heaters, this texturing heater is a device having an extraordinarily small surface. The transmission of heat to the running threads is possible, here, with the smallest possible heat losses and the lowest possible load on the air-conditioning system.

Figure 3:
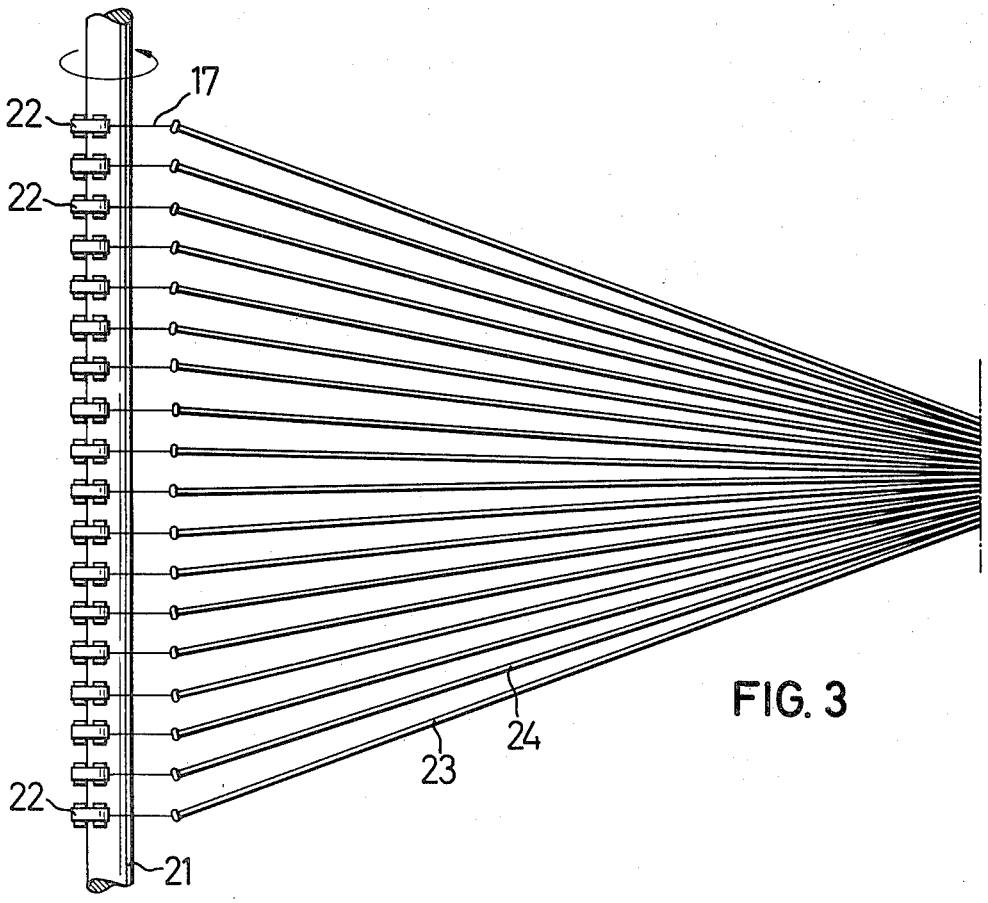
FIG. 3 shows, in a plan view, the thread run of a section in the zone A-B of FIG. 1.

The run of the threads from the first delivery mechanism 3 to the texturing heater 6 is illustrated as a plan view in FIG. 3 for the segment A-B according to FIG. 1. In this exemplary embodiment, 18 working positions are contained in each machine section, that is to say, eighteen threads 17 can be processed simultaneously. The delivery mechanism 3 is shown with the continuous shaft 21 and with 18 belt drives 22. The thread run to the heater 6 is guided through tubes which have at their start attachments made of sintered ceramic. The tubes 23, 24 run in a star-shaped manner in the direction of the inlet to the texturing heater 6. In so doing, the individual tubes 23, 24 can run in a plane, as indicated in FIG. 1. However, it is also conceivable that the tubes should leave this plane before entry, for adaptation to the closely bunched passage through the texturing heater 6. The number of working positions per section is, conventionally, between 10 and 30 and depends essentially on constructive features, such as, for example, the selected thickness of the machine frame and the apportioning of, for example, the take-up devices in this machine frame. In the example according to FIG. 1, one set of three take-up devices located above one another is arranged on each of the two sides of the working gangway. A section consists of three sets of this type next to one another, that is to say, it contains 18 working positions. Other numbers of working positions per section are, of course, possible in the case of a different apportioning of the take-up devices. It has been shown that the oblique guidance of the threads to the heater, as illustrated in FIG. 3, and also the oblique guidance from the heater 6 to the twist inducers 8, 9 result in no impairment in the textile values and, for example, in the dye affinity of the treated threads, if the number of individual thread-guide devices brought together by means of oblique guidance is limited to approximately 30 in the texturing heater 6.

Figure 4:
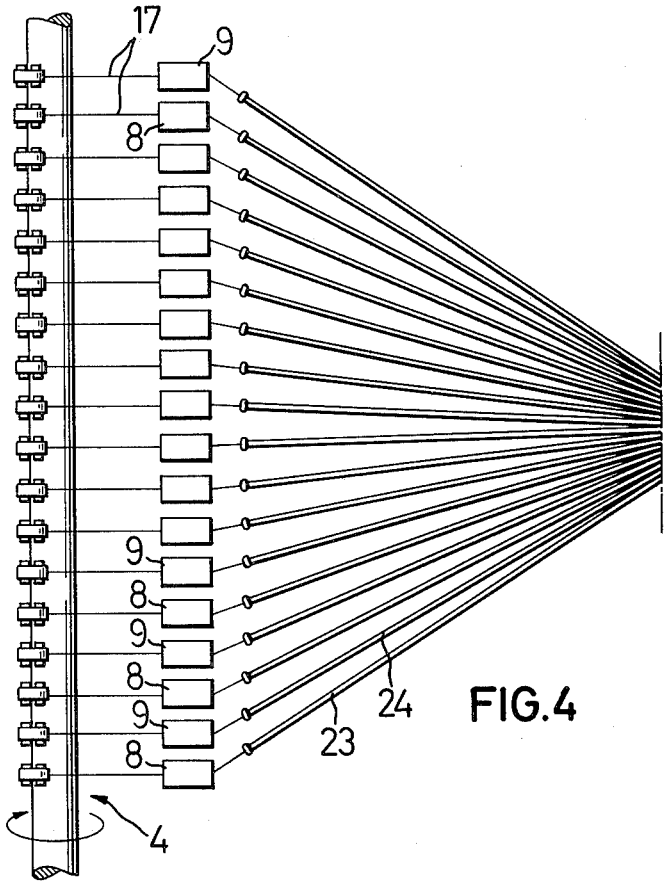
FIG. 4 shows, likewise in a plan view, the zone C-D according to FIG. 1.

The thread run within the region C-D according to FIG. 1 of the 18 working positions of a section is illustrated in FIG. 4. The tubes, which were combined into a compact bundle in the texturing heater 6, are drawn apart in a star-shaped manner in the cooling zone and lead to the twist inducers 8, 9. The reference numerals 23 and 24, which were selected for characterizing the thread-guide devices in FIG. 1, have been chosen again to designate these. The twist inducers 8, 9 are arranged in two planes, as is evident from FIG. 1. These twist inducers, for example single-axis or triple-axis friction twist inducers, generate the desired twist which, in the running threads 17, passes through the cooling zone, the heater and the thread-guide members 23, 24 back to the delivery mechanism 3. In spite of the different angles from working position to working position and also despite the different distances which the threads have to cover on their way from the delivery mechanism 3 to the delivery mechanism 4, no influencing of the texturing quality can be observed. After leaving the twist inducers 8, 9, the threads run to a common further delivery mechanism 4 which has the same design as the delivery mechanism 3. Because of the oblique guidances which are carried out, a very narrow machine spacing is possible. If the machine is equipped with a set heater 7, this set heater can also take up a substantially smaller volume than was possible hitherto in the case of the mirror-image design, and this even assumes that an oblique guidance is avoided in the set heater. The further construction of the machine largely corresponds to known prototypes, that is to say, a further delivery mechanism 5 is provided after the set heater 7. The threads run from this further delivery mechanism onto the various take-up devices 11–16.

The use of pipelines or tubes for fixing the thread run of each working position yields distinct advantages when the machine is threaded up. Here, it is possible, by means of simple devices, such as, for example, suction pistols, to convey the thread to be attached through the tubes, without the other threads being implicated by this attaching operation. To prevent the pipelines being damaged by the running threads, it is appropriate, in this case, to use thread guides made, for example, of sintered ceramic or the like at the direction change points of the thread.

In comparison with the known texturing machines, the device according to the invention has only half the number of delivery mechanisms, that is to say, if a set heater is used, only 3 continuous delivery-mechanism shafts are necessary, as against 6 shafts of this type otherwise. It is possible to simplify the device further and, in particular, to make repairs and maintenance easier, if the three remaining delivery-mechanism shafts of the delivery mechanisms 3, 4 and 5 are driven by frequency-controlled individual motors. In this case, the entire gearing which is otherwise required is omitted. A measure of this type leads, furthermore, to a distinct reduction in the noise level. The use of frequency-controlled individual motors also makes it possible to carry out the entire setting of the machine by means of preprogrammed data carriers, for example by the insertion of a punched card. A particularly simple design of the drives of the twist inducers is obtained by the use of frequency-controlled individual drives also at this point. This measure enables the machine spacing to be reduced further, that is to say, the space requirement which is needed for each working position in a section.

The good accessibility of all the machine parts, for example for repairs, is obvious from FIG. 1 because of the chosen asymmetrical arrangement. If a compact heater is used as the texturing heater, it is possible to save considerable quantities of heat, in comparison with the state of the art. By arranging the texturing heater in a horizontal direction above the creel installation, in conjunction with the thread-guide devices in tube form, extended heating stages, but also adjoining cooling zones, can be provided, without the machine requiring an undesirable overall height. The slight oblique guidances produce practically no accumulation of twist on the path of the thread between the heater and twist inducer. If desired, an absolutely straight thread run between the exit from the texturing heater 6 and entry into the twist inducers 8 and 9 can be adhered to.

I claim:

1. A texturing machine for false-twist texturing including at least one treatment section having between 10 to 30 thread working positions, said treatment section comprising thread delivery means, a common texturing heater, means for guiding threads from said delivery means along converging paths to said texturing heater and for guiding the threads through the heater in a compact non-planar bundle, false twisting means downstream of the texturing heater in the direction of movement of said threads, means for guiding threads from said texturing heater to said false twisting means along diverging paths, said false twisting means comprising a plurality of false twist inducers separately associated with each of the threads and arranged in two banks alternated with each other in two spatially offset planes; a set heater for said threads located in series with said false twisting means and downstream thereof in the direction of travel of said threads, creel means for taking up threads passing from said set heater, and a single operating gangway between said creel means and delivery means, whereby the threads heated in each of said treatment sections pass along paths of travel which differ from one another in length.

2. A texturing machine as defined in claim 1 wherein the texturing heater and set heater receive and heat all threads moving through the treatment section.

3. A texturing machine as defined in claim 2 including a plurality of identical treatment sections located next to one another, said single gangway extending through all sections of the machine.

4. A texturing machine as defined in claim 1 wherein said means for guiding the threads comprise a plurality of separate closed tubes individually associated with each separate thread for guiding the same along its path of travel to and from said heater.

5. A texturing machine as defined in claim 4 wherein said tubes pass through said common texturing heater along generally parallel paths of travel in a compact non-planar bundle.

6. A texturing machine as defined in claim 1 including a cooling zone, said guide tubes individually guiding the threads through the cooling zone.

7. The texturing machine as claimed in claim 6, wherein the twist inducers are driven by frequency-controlled individual motors.

8. A texturing machine as defined in claim 7 wherein said delivery means, false twisting means and creel means each include drive shafts and said machine includes frequency controlled individual motors for driving said shafts.

* * * * *